United States Patent [19]

Cederroth et al.

[11] Patent Number: 4,899,976

[45] Date of Patent: Feb. 13, 1990

[54] ICE CUBE TRAY

[75] Inventors: Sture C. Cederroth, New York, N.Y.; Bruce B. Zutler, Stamford, Conn.

[73] Assignee: Arctic Icewater, Inc., New York, N.Y.

[21] Appl. No.: 188,278

[22] Filed: Apr. 29, 1988

[51] Int. Cl.[4] ..... F25C 1/22

[52] U.S. Cl. ..... 249/61; 206/484.2; 206/524.1; 206/524.6; 206/525; 206/531; 206/532; 206/539; 249/121; 249/122; 249/127; 249/135; 426/515

[58] Field of Search ..... 249/52, 61, 121, 122, 249/127, 134, 135, 140; 206/484, 524.2, 531, 532, 539, 820, 484.2, 524.1, 524.6, 525; 426/515

[56] References Cited

U.S. PATENT DOCUMENTS

| | | | |
|---|---|---|---|
| 2,955,044 | 10/1960 | Tupper | 249/127 |
| 3,380,578 | 4/1968 | Sparks | 206/532 |
| 3,689,458 | 9/1972 | Hellstrom | 206/532 |
| 3,759,379 | 9/1973 | Wrede | 206/524.2 |
| 3,783,089 | 1/1974 | Hurst et al. | 206/532 |
| 4,011,949 | 3/1977 | Braber et al. | 206/532 |
| 4,023,768 | 5/1977 | Herrera-Casasus | 249/127 |
| 4,105,118 | 8/1978 | Williams, Jr. et al. | 206/524.2 |
| 4,287,171 | 9/1981 | Jordy et al. | 206/484.2 |
| 4,305,502 | 12/1981 | Gregory et al. | 206/532 |

*Primary Examiner*—James C. Housel
*Attorney, Agent, or Firm*—Grimes & Battersby

[57] ABSTRACT

There is provided an ice tray and ice cubes formed therein in which the ice cubes contain embossments. The ice cube tray includes a base having a plurality of cavities. Each cavity has a bottom and a plurality of said walls and preferably the bottom has a surface in the cavity which surface has a protuberance. The ice tray also includes a cover secured to the base. Once a formed ice cube is removed from a cavity, the cavity can not be used to form a new ice cube.

9 Claims, 3 Drawing Sheets

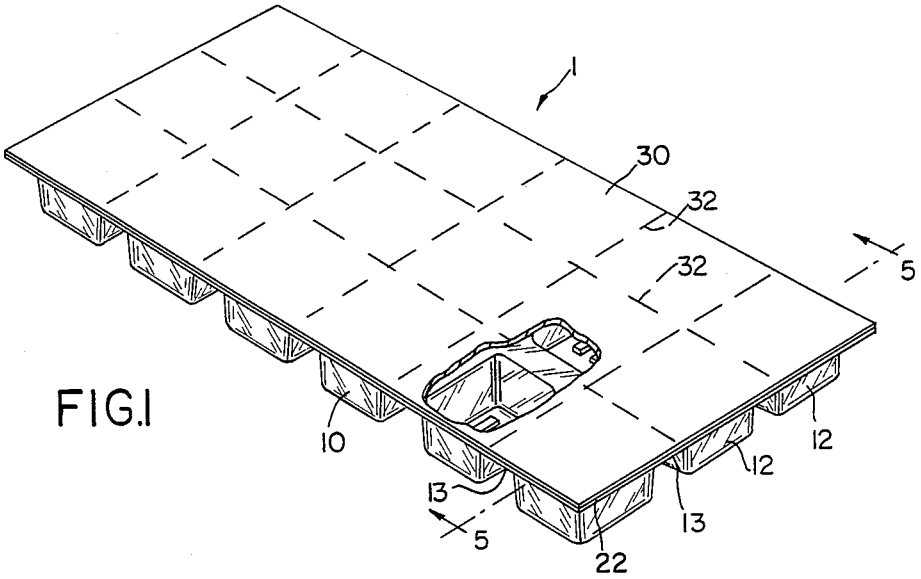
FIG.1
FIG.2
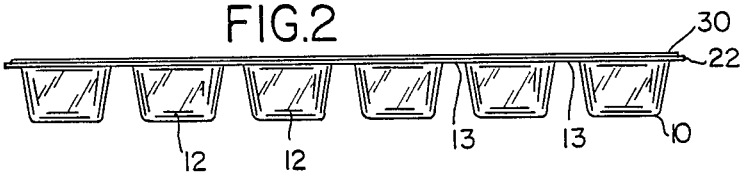
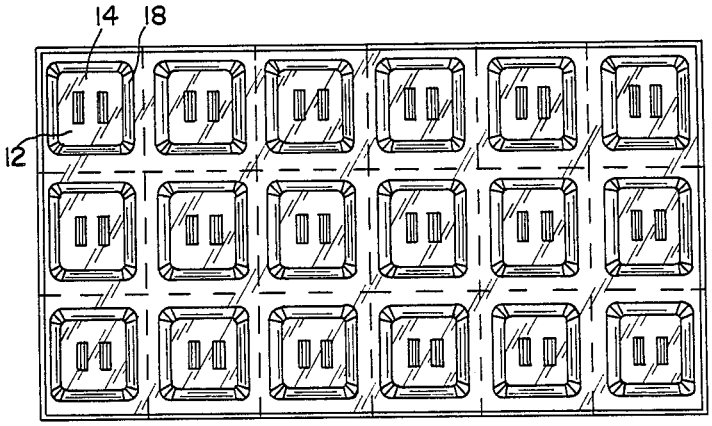
FIG.3

ICE CUBE TRAY

BACKGROUND OF THE INVENTION

1. Field of the Invention

The present invention relates generally to an enclosed ice tray and ice cubes formed therein and, more particularly, to a non-reusable enclosed ice tray in which individual ice receptacles or cavities for forming ice cubes are filled with a desired liquid when the ice cavities are enclosed. Therefore, a filled cavity must be broken to reach its contents. Accordingly, this structure provides that the cavity can not be reused thereby assuring that the contents of the cavity can not be contaminated or filled by another with an undesired liquid. Further, the ice cubes formed in the tray have an embossment or indicia which both identifies the ice cube and increases the rapidity with which the ice cube cools a fluid in which the ice cube is placed.

In the present environment in which one is concerned of the contaminants found in water supplies, many people desire to drink fluid from a filtered or controlled source, such as "pure" spring water. Further, it is believed that many liquids, such as liquor, is enhanced by mixing that liquid only with "pure" spring water instead of tap water. Accordingly, the ice cubes used in such drinks should also be made of "pure" spring water.

Unfortunately, to assure that the ice cubes will be made only of "pure" spring water it is necessary that the manufacture have some way of assuring, from the time the ice or liquid that forms the ice cube leaves its facility to the time it reaches the ultimate customer, that the less costly or undesired tap water will not be included.

Thus, there is a need to provide an ice forming tray which permits the manufacturer or producer to seal the tray with the desired liquid, such as "pure" spring water, at the time the manufacturer fills the tray so that the ice cubes formed therein cannot be contaminated, and to construct the tray so that once an ice cube is removed from a cavity of the tray that cavity cannot be reused while the remainder of the tray remains intact. It is also desired that the formed ice cube itself have some indicia or way to identify that it is water from a certain desired source.

2. Description of The Prior Art

It is known in the art to provide an ice tray in which the receptacles for forming the ice cubes are enclosed. Specifically, there is known many types of ice trays which include a cover or lid to enclose the ice forming receptacles, however such covers can be readily removed to permit access to the receptacle portion of the tray so that a formed cube can be removed and the receptacle can be readily refilled. Some such trays include those shown in U.S. Pat. Nos. 4,432,529 to McMillan, which issued on Feb. 21, 1984; 3,414,229 to Norberg, which issued on Dec. 3, 1968; 3,374,982 to Sallade, which issued on Mar. 26, 1968; 3,019,617 to Malthaner, et al, which issued on Feb. 6, 1962; 2,804,755 to Ansel, which issued on Sept. 3, 1957; 2,769,316 to Candor, which issued on Nov. 6, 1956; 2,629,987 to Chase, which issued on Mar. 3, 1953; 2,613,512 to Gaugler, which issued on Oct. 14, 1952; 2,503,306 to Storer, which issued on Apr. 11, 1950; 2,069,195 to Chilton, which issued on Feb. 2, 1937; 2,011,849 to Chilton, which issued on Aug. 20, 1935; 2,011,289 to Klyce, Jr., which issued on Aug. 13, 1935; Re.19,322 to Tanger, which issued on Sept. 18, 1934; 1,896,849 to Newman, which issued on Feb. 7, 1933; and the commercial ice tray product sold by Cooly International, Inc., and the commercial ice tray product called Kwik Kubes sold by Hyman Products Inc. of St. Louis, Mo.. Both of these commercial products are ice cube bottles having a removable cap and having a side of the ice cube bottle having a plurality of semi-circular cavities for forming ice cubes.

Some such trays include an upper portion for forming the individual ice cubes, a lower portion adapted to receive the formed ice cubes, and a divider to separate the upper portion from the lower portion of the tray. One such tray is shown in U.S. Pat. No. 3,135,101 to Nigro, which issued on June 2, 1964.

Other enclosed structures or devices for forming individual ice cubes include a bag or other resilent structure separated into individual compartments. Some such devices are shown in U.S. Pat. Nos. Re.31,890 to Vangedal-Nielsen, which issued on May 21, 1985; 3,306,567 to Frei, Sr., which issued on Feb. 28, 1967; 2,966,041 to Zearfoss, Jr., et al, which issued on Dec. 27, 1960; and 2,964,920 to Staebler, which issued on Dec. 20, 1960. The Vangedal-Nielsen patent permits the ice cube to form a circular shape instead of the conventional square shape cube. Other such ice trays having covers or lids and which permit the cubes to form a shape other than a square or rectangle shape include U.S. Pat. Nos. 4,417,716 to Pa., et al, which issued on Nov. 29, 1983 and 2,049,902 to Fischer, which issued on Aug. 4, 1936, and a commercial product sold by Hello Productions, Inc. of Elk Grove Village, Ill. under the mark Ice Shapers. The Hello commercial product consists of a two piece tray. The base of the tray has a plurality of protuberances which form a half of an animal shape, while the cover or top of the ice tray also has a plurality of protuberances which form the other half of the same animal shape. When the top is placed over the base and liquid is placed in the protuberance, the animal shaped is formed into ice. This ice tray provides for the repeated formation of ice cubes in these animal shapes.

All of the above provide that the tray can be reused so as to form new ice cubes after the first ice cubes have been formed therein and removed. Accordingly, it is possible for one to fill the tray at any time with any type of liquid. Therefore, these ice trays do not provide any way to assure that only the liquid desired by the manufacturer is used in the formed ice cube.

Further, heretofore, no ice tray provided that the formed ice cube have an embossment or other indicia. The only suggestion of forming ice with embossments is U.S. Pat. No. 4,147,324 to Walter, which issued on Apr. 3, 1979. This patent is directed to a mold for making shotgun targets out of ice. In this patent, it is simply provided that the ice or target have a convex depression.

Thus, heretofore ice trays have not provided individual receptacles or cavities which can only be filled once, and, by the manufacturer, thereby assuring that only desired ice cubes can be formed therein. Further, all conventional ice trays also fail to provide for an embossment or other identification in the ice cube itself.

SUMMARY OF THE INVENTION

Against the foregoing background, it is a primary object of the present invention to provide an enclosed ice cube tray which provides individual cavities for the formation of individual ice cubes in which once a formed ice cube is removed from a cavity that cavity cannot be reused.

It is another object of the present invention to provide such an ice tray in which an ice cube can be removed from one cavity without disturbing the other cavities and the ice cubes therein.

It is a still another object of the present invention to provide such an ice tray in which each ice cavity is filled, normally by the manufacturer, as the cover of the tray is permanently secured to the base of the tray.

It is yet another object of the present invention to provide such an ice tray in which each cavity once filled with liquid is prevented from contamination.

It is still yet another object of the present invention to provide such an ice tray which assures that the contents of a cavity cannot be contaminated since the contents thereof cannot be effected unless the cavity is destroyed.

It is yet still another object of the present invention to provide such an ice tray which forms individual ice cubes each having an embossment or other identification indicia.

It is yet still another object of the present invention to provide such an ice tray in which the formed ice cubes have an increased surface area which can contact a liquid in which it is placed thereby decreasing the time required to cool a drink.

It is yet still another object of the present invention to provide such an ice tray which is relatively inexpensive.

It is yet still another object of the present invention to provide such an ice tray which is readily transportable, without any measures taken to prevent spillage of liquid in the tray during transporting.

To the accomplishments of the foregoing objects and advantages, the present invention, in brief summary, comprises an ice tray having a base, a cover and means for securing together the base and the cover. The base includes a plurality of individual cavities for receiving liquid therein and the cover is sized to mate with the base so as to form an closed tray which encloses the liquid therein. The cavity has a protuberance which creates an indicia in the liquid frozen in the cavity and once a formed ice cube is removed from a cavity that cavity cannot be reused to form an ice cube.

BRIEF DESCRIPTION OF THE DRAWINGS

The foregoing and still other objects and advantages of the present invention will be more apparent from the following detailed explanation of the preferred embodiments of the invention in connection with the accompanying drawings wherein:

FIG. 1 is a perspective view of the ice tray of the first embodiment of the present invention with the ice cube formed therein;

FIG. 2 is a front elevation of the ice tray of FIG. 1;

FIG. 3 is a bottom view of the ice tray of FIG. 1;

DESCRIPTION OF THE PREFERRED EMBODIMENTS

Figure 4:
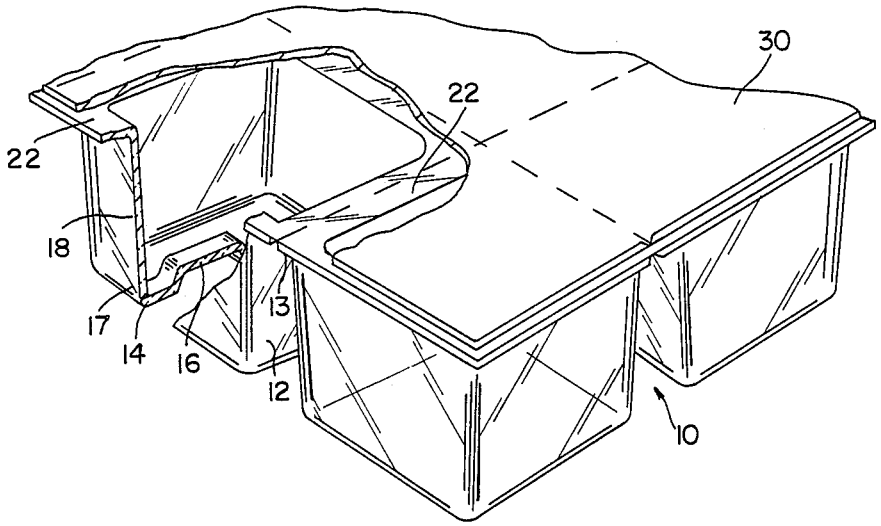
FIG. 4 is a partial sectional view of a portion of the ice tray of FIG. 1.
Figure 5:
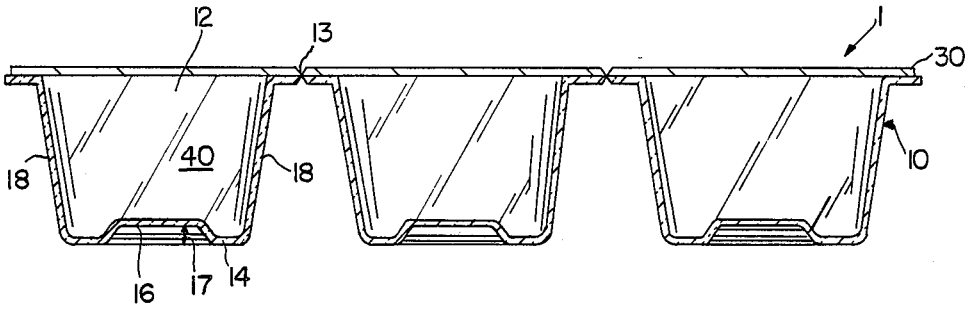
FIG. 5 is a sectional view taken along line 5—5 of FIG. 1 with an ice cube formed therein.

Referring to the drawings and, in particular, to FIG. 1, an ice tray, generally represented by reference numeral 1, includes a base 10 and a cover or lid 30. The base 10, when formed, has a plurality of receptacles or cavities 12 each adapted to receive a liquid, such as water, therein and has upper edges 22. As shown in FIGS. 1 and 2, the cover 30, which is sized complementary to the base 10 and, in particular, to the upper edges 22 of the base, is adapted to cover the base so that the ice tray 1 forms a completely closed structure.

The base 10 can be formed on conventional thermoforming equipment from a roll of flat stock. Basically, the flat stock is passed through the thermoforming equipment to punch out or form the plurality of cavities 12 having spacing 13 between each adjacent pair of cavities.

Figure 7:
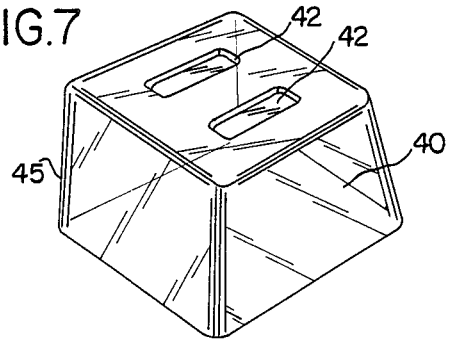
FIG. 7 is a perspective view of an ice cube formed from the ice tray of FIG. 1.

Each cavity can be of any size, however in view of the size of normal refrigerators and normal drinking glasses it is recommended that the cavity be sized to form ice cubes 40, illustrated in FIG. 7, having a mean size of approximately 27 by 27 by 27 mm and with each cube holding about 0.02 liters of liquid, such as water. It is also recommended to meet existing freezer or refrigerator spacing that the spacing 13 between each adjacent pair of cavities 12 be approximately 8 to 20 mm.

The term ice cube as used in this application means the formation of a block of ice into any size and any shape. Accordingly, the ice cube can have any shape, such as an oval, circular, square, or rectangular, or it may have a combination of such shapes, or it may also some surfaces of the ice cube flat while other surfaces have sharp angles or grooves.

Figure 6:
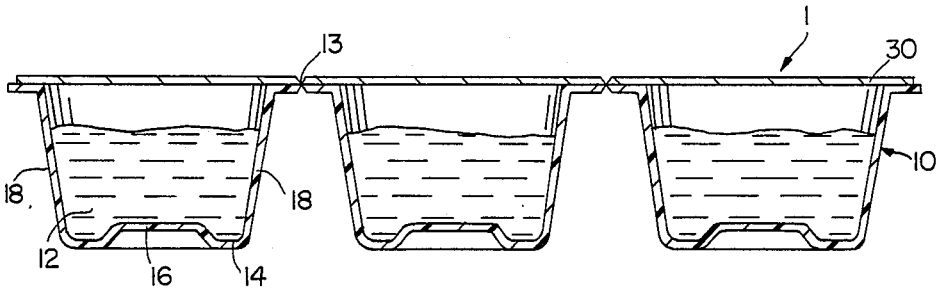
FIG. 6 is a sectional view taken along line 5—5 of FIG. 1 with the ice tray formed of water and before formation of the ice cube.

Referring to FIGS. 3 through 6, it is preferable that the thickness of the bottom 14 and the four walls 18 of each cavity 12 be as thin as possible so as to minimize the amount of material, and thus the cost and the weight of the ice tray 1, yet permit desired deformation to eject the formed ice cube 40 from the cavity. However, each cavity must be thick enough to cause the ice cube 40 therein to freeze properly, to withstand unintentional piercing, and to maintain its shape or integrity during freezing and thereafter. In a preferred embodiment, it is also desired that each cavity 12 of the ice tray 1 provide means to form indicia in the ice cube 40. The means to form the indicia can be a protrusion or protuberance either on the bottom 14 or on the walls 18 of the cavity. However, the protuberance must be positioned such as to permit the formed ice cube to slide out of the cavity after formation. Accordingly, it is preferred that the protuberance be at the bottom 14 of the cavity. Therefore, each cavity, preferably, has a bottom 14 which is of a thickness greater than the thickness of the four walls 18 of the cavity and the bottom of the cavity has at least one protuberance 16 in order to effect an embossment in an ice cube 40 to be formed in the cavity. The thickness of the bottom 14 would, preferably, be thicker than the thickness of the walls 18 in order to provide a protuberance 16 of sufficient height 17 so as to provide an embossment 42 of sufficient depth in the formed ice cube 40 and also to withstand any deformation or expansion. It is preferred that the thickness of the bottom 14 of the ice tray 1 be in a range of 20 to 30 mils., that the thickness of the walls 18 be approximately 15 mils., and that the height of the protuberance 17 be of virtually any height, however the suggested height is approximately 2 mm. As stated above, the protuberance 16 creates the indicia or embossment 42, as shown in FIG. 6, in the ice cube 40 and accordingly the bottom 14 can not expand, i.e. the integrity of the bottom must be maintained, or else the indicia to be formed on the ice cube 40 would not be clear. The height 17 of the protuberance 16, which is substantially the depth of the embossment 42, should be sufficient so that the embossment shall be clearly seen in the formed ice cube 40. The protuberance 16 can be of any configuration so that it could state the trademark, name, logo or design of the owner or the manufacturer or the distributor of the ice tray 1 or the ice cubes 40. The protuberance 16 or indicia producing means, preferably, is on the bottom 14, and not the walls 18 of the cavity 12, to facilitate the release of the formed ice cube 40 from the ice tray 1. However, the indicia can be on the walls 18 provided the indicia is in a basically vertical plane to permit the formed ice cube to slide out of the cavity.

To also facilitate the release of the formed ice cube 40 from a cavity 12 of the ice tray 1, it is preferred that the walls 18 of the cavity be tapered downward from the top to the bottom 14 of the cavity. The tapering assists in permitting the formed ice cube 40 to slide out of the cavity 12. The taper should be as minimal as possible in order to increase the volume of the formed ice cube 40, however it is believed that the taper needs to be at least one degree.

The stock for the base 10 of the ice tray 1 can be selected from any material that provides the above and following criteria, and which material can be thermoformed. The preferred stock is basically a polyvinyl chloride (PVC) plastic. In a more preferred embodiment, the stock includes a base film made of polyvinyl chloride (PVC) which has a coating of polyvinylidene chloride (PVDC) thereon and then polyethylene (PE) is laminated onto the PVDC coating of the PVC. The selection of the type of material for the base is predicated on the desire to use a relatively inexpensive and readily available material which also is strong enough so as not to be unintentional pierced thus protecting and insuring the purity of the liquid therein. Further, the material should provide a moisture vapor barrier thereby basically preventing the water sealed in the cavity 12 from evaporating prior to and during freezing and should be able to withstand both the high temperature which emanates during the thermoforming process and the sub-freezing temperature needed to form the ice cubes. Still further, it is desired that the material be clear so that the user can readily determine whether the ice cube is fully formed, i.e. fully frozen and, of course, the material must be such as to meet federal government regulations concerning ingestion. Further, as discussed below, the polyethylene layer serves to bind the base 10 to the cover 30.

The cover or lid 30 is sized to fit on the base 10 so as to form a complete enclosure for the liquid in the ice tray thereby preventing entry of any material or liquid or gas into the tray. It is preferred that the cover 30 be sized and shaped complementary to the upper edges 22 of the base 00 so as to minimize the amount of material and the overall size of the tray. The base 10 and the cover 30 are secured together, as shown in FIG. 2, by heating and pressing together the base 10 and the cover 30. Actually, any conventional material may be used as the adhesive to secure together the base 10 and the cover 30 provided the adhesive material does not adversely react with the cover or liquid in the ice tray 1.

It is preferable that as much liquid as possible be included in the each separate enclosed cavity, however some space must be left to provide for expansion of the water that occurs during the freezing process. It has been found that in the preferred cavity, i.e. the cavity having 27 by 27 by 27 mm dimensions, the expansion is approximately 6% so that approximately 6% of the cavity must not be filled with liquid as shown by way of illustration in FIG. 6.

The cover 30 can be made of any light weight material that is strong enough to resist unintentional breakage, but once broken can not be repaired, and can be securely bond to the base 10 that it will not separate therefrom. Further, the material must meet government regulations since the ice cubes formed therein may be ingested. It is important that the material is of a strength that it needs to be broken to gain access to each cavity 12, yet is light in weight and relatively inexpensive and readily available. It is preferred that the material be made of a aluminum, approximately a 30 micron aluminum, and that it have a poly vinyl chloride (PVC) - poly vinylidene chloride (PVDC) coating on the side of the material that contacts the upper edges 22 of the base 10. The coating provides a more secure bond with the PVC-PVDC-PE material of the base 10. The cover 30, preferably, should be of a thickness of approximately 30 microns.

Referring to FIG. 1, the cover 30 includes a plurality of first perforations or groove lines 32 basically in the form of a square to outline the top of the cavity 12. The perforations 32 must not pierce through the cover or else the cavity and the contents therein can become contaminated, yet should be deep enough so as to facilitate the separation of each individual cavity 12 form the remainder of the plurality of cavities. Further, the spacing 13 between each pair of cavities 12 should include perforations which must align with the first perforations 32 of the cover 30 so that a user can readily detach a single cavity from the remaining cavities without disturbing the remaining cavities.

Figure 8:
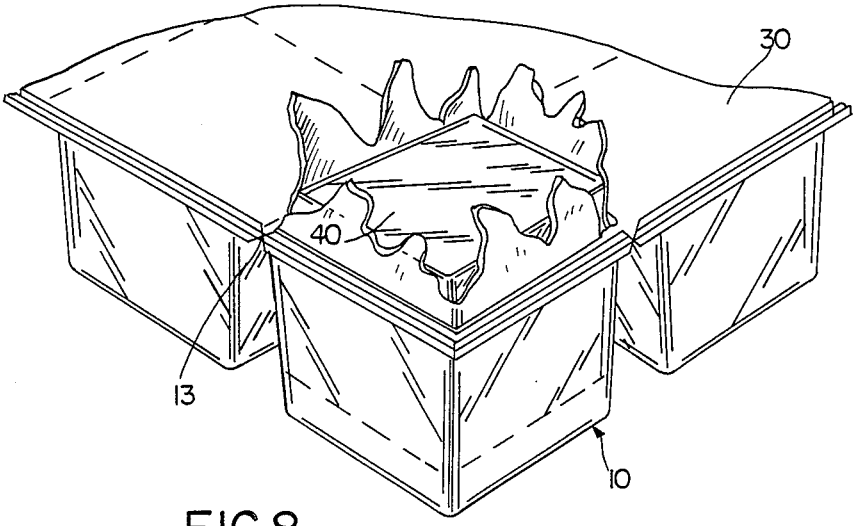
FIG. 8 is a perspective view of the ice tray of FIG. 1 with one of the ice cubes breaking through a cavity.

To release or eject a formed ice cube 40 out of a cavity 12, the user simply has to apply pressure to the bottom 14 and perhaps the walls 18 of the cavity so that the formed ice cube breaks the cover 30 preferably in the centermost portion of the cover and travels through the created opening and out of the cavity as shown in FIG. 8. By the materials used for the cover 30, it is believed that the cover will readily break rather than becoming unbonded from the upper edges 22 of the base 10. Further, by the coating materials used on the inside surface of the cover and the cavity and the tapering of the cavity, it is believed that the ice cube 40 shall readily eject from the cavity and not stick to the surfaces thereof.

As shown in FIG. 7, the formed ice cube 40 includes the embossment 42. The edges 45 of the formed ice cube may be arcuate to complement the shape of the inside edges of the cavity 12 and to further facilitate the ejection of the formed ice cube from the cavity. By the embossment 42, the ice cube 40 has an increase of surface area. It is known that the increased surface area ice cube will cool a drink in which it is placed more quickly than a lesser surface area ice cube since more of the drink is effected or in contact with more surface of the ice cube.

The ice tray 1 is formed and filled as follows. The rolled stock goes through the forming die of a thermoforming machine and forms the base 10 having the plurality of cavities 12. The cavities are then filled with the desired liquid, such as "pure" spring water, and the cover 30 is secured to the base 10 by simultaneously heating and pressing together the base and the cover. It is preferred that the manufacturer bond the cover to the base as soon as possible, and almost simultaneously with the filling of the cavities, to further assure that no contaminants enter the cavities.

The ice tray 1 is made from conventional rolls of readily available and inexpensive plastic type material and is formed on readily available thermoforming equipment. The ice tray is constructed to insure that only the desired liquid, such as "pure" spring water, is used to form the resultant ice cubes by the features that the cavities are filled by the manufacturer and one can not gain access to the cavity without destroying or breaking the cover portion of the cavity so that the cavity cannot be reused. Further, if a user notes that the cover portion of the cavity is damaged, the user has an indication that the contents of the cavity may be contaminated, i.e. may include undesired matter. Still further, the ability of the ice tray to provide an embossment in the formed ice cube results in a product which contains its own indicia or identification so that even when removed from the ice tray the user can determine the source of the product and, moreover, the ice cube provides per unit volume a greater surface area resulting in more rapid cooling of a drink in which the ice cube is placed.

Having thus described the invention with particular reference to the preferred forms thereof, it will be obvious that various changes and modifications may be made therein while retaining the advantages and benefits of the present invention and without departing from the spirit and scope of the invention as defined by the appended claims.

Wherefore, we claim:

1. An ice cube tray for containing a liquid which forms into a plurality of ice cubes, said tray comprising:

a base having a plurality of cavities each for receiving a portion of the liquid, each of said plurality of cavities having a bottom and a plurality of side walls, wherein each of said plurality of cavities has said bottom of a thickness greater than the thickness of each of said plurality of walls, said bottom having a surface in said cavity and having a protuberance formed on the surface, wherein the protuberance of one of said plurality of cavities creates an embossment in the ice cube formed in the one cavity;

a cover permanently secured to said base; and means for permanently securing said base to said cover, wherein the liquid is entirely enclosed in said ice tray and therefore cannot be contaminated by matter outside of said ice tray when said base is secured to said cover, and wherein once a formed ice cube is removed from a cavity that cavity cannot be reused to form a new ice cube.

2. A structure comprising:

a plurality of aqueous, liquid portions which, upon freezing, form a plurality of ice cubes; and, an ice tray for containing said plurality of aqueous, liquid portions, said ice tray including:

a base having a plurality of cavities each receiving one of said plurality of liquid portions, each of said plurality of cavities having a bottom and a plurality of side walls, a cover permanently secured to said base to avoid exposure of the liquid of said plurality of liquid portions and said plurality of ice cubes formed therefrom to matter outside of said ice tray, said cover having a plurality of areas each corresponding to a different one of said plurality of cavities; and means for permanently securing said cover to said base about an upper perimetric edge of said plurality of side walls of each cavity, wherein each of said formed ice cubes is removed from its respective cavity by rupturing the corresponding one of said plurality of areas of said cover, and wherein a substantial portion of the upper edge retains a portion of the cover after rupturing of a cavity to provide a positive indication that the liquid or said ice cube formed therefrom has been exposed to matter outside of said ice tray.

3. The structure of claim 1, wherein said cover is made of aluminum.

4. The structure of claim 3, wherein said aluminum is coated with a mixture of poly vinyl chloride and poly vinylidene chloride.

5. The structure of claim 2, wherein said base is made of a plastic material.

6. The structure of claim 5, wherein said plastic material includes a base film made of poly vinyl chloride, a coating of poly vinylidene chloride formed on said film, and polyethylene laminated onto the poly vinylidene chloride coating.

7. The structure of claim 2, wherein each cavity of said tray has a protuberance whereby each ice cube formed in said ice tray has an embossment formed by said protuberance which provides indicia for identification and an increase in surface area per unit volume over a non-embossed ice cube of the same volume for more rapid cooling of a liquid medium in which the ice cube is placed.

8. The structure of claim 2, wherein said bottom has a surface with a protuberance formed therein so that each of the formed ice cubes has an embossment formed therein by said protuberance.

9. The structure of claim 2, wherein each respective area and cavity defines a region within which one of said plurality of liquid portions can, upon freezing, be formed into one of said plurality of ice cubes, and wherein no more than 94% of the region is filled with liquid.

* * * * *